US006886827B2

(12) United States Patent
Dachtler

(10) Patent No.: US 6,886,827 B2
(45) Date of Patent: May 3, 2005

(54) LIFTER AND SEPARATOR FOR STACKED FLEXIBLE FLAT WORKPIECES

(75) Inventor: Siegfried Dachtler, Stuttgart (DE)

(73) Assignee: Trumpf GmbH + Co. KG, Ditzingen (DE)

( * ) Notice: Subject to any disclaimer, the term of this patent is extended or adjusted under 35 U.S.C. 154(b) by 0 days.

(21) Appl. No.: 10/005,576

(22) Filed: Dec. 4, 2001

(65) Prior Publication Data

US 2002/0096815 A1 Jul. 25, 2002

(30) Foreign Application Priority Data

Dec. 4, 2000 (EP) ..... 00126628

(51) Int. Cl.[7] ..... B65H 3/46
(52) U.S. Cl. ..... 271/106; 271/91; 271/977; 414/797
(58) Field of Search ..... 271/90, 91, 97, 271/106; 294/65; 414/797

(56) References Cited

U.S. PATENT DOCUMENTS 3,673,759 A * 7/1972 Ayres et al. ..... 53/459
4,806,071 A 2/1989 Sartoreo
5,433,426 A * 7/1995 Bond ..... 271/92
5,535,997 A * 7/1996 Croyle et al. ..... 271/12
5,622,362 A * 4/1997 Shiiki et al. ..... 271/91
5,676,364 A * 10/1997 Shiiki et al. ..... 271/91
6,345,818 B1 * 2/2002 Stephan et al. ..... 271/91

FOREIGN PATENT DOCUMENTS

| | | | |
|---|---|---|---|
| DE | 3305081 | C2 | 8/1983 |
| DE | 3641984 | A1 | 6/1987 |
| DE | 3800907 | C2 | 7/1988 |
| DE | 4219299 | A1 | 12/1993 |
| DE | 4220398 | A1 | 12/1993 |
| EP | 0 734983 | A2 | 10/1996 |
| GB | 2 304 099 | A | 3/1997 |

* cited by examiner

*Primary Examiner*—Donald P. Walsh
*Assistant Examiner*—Kaitlin Joerger

(57) ABSTRACT

A lifter device for separating the uppermost of a stack of flexible flat workpieces in suction holders for engaging a sheet when suction is applied thereto. At least one suction holder adjacent a side of the frame is movable independently of other suction holders spaced inwardly therefrom to bend an edge portion of the workpiece upwardly. A stop is provided on the frame to limit upward motion of the body of the sheet as the edge portion bends upwardly.

15 Claims, 6 Drawing Sheets

LIFTER AND SEPARATOR FOR STACKED FLEXIBLE FLAT WORKPIECES

BACKGROUND OF THE INVENTION

The present invention relates to devices for lifting and separating flexible flat workpieces in a stack utilizing suction holders to grip the uppermost workpiece and to separate adjacent workpieces which are stuck together.

In current methods of machining flat sheet metal workpieces, the workpieces being processed are fed to the machine individually from a corresponding stack. Especially in cases where the stacked workpieces are coated with a film, and/or, in the case of metal workpieces, are oiled for corrosion protection, problems can occur when separating the workpieces because adjacent workpieces in the stack may stick together. This problem is encountered especially with thin workpieces.

To isolate flat, horizontally stacked workpieces, European Patent 0 639 519 discloses a device of the type mentioned previously, which uses a large number of suction holders next to another in the longitudinal direction on the edge of the workpiece. Some of the suction holders are reoriented along the edge of the workpiece in an effort to bend the edge upwardly and separate it from the sheet therebelow.

However, this device is not always effective in providing a reliably, functionally safe separating action.

It is the object of the present invention to provide a novel lifter and separator for stacked flexible flat workpieces which utilize a simple mechanical element to provide a highly effective and safe separator.

It is also an object to provide such a lifter and separator which is especially useful with thin flexible workpieces.

Another object is to provide such a separator which is relatively simple in construction and operation.

It has now been found that the foregoing and related objects and advantages may be readily attained in a sheet lifter and separator for lifting and separating the uppermost sheet of a stack of workpieces from the sheet disposed therebelow. This includes a lifter having a frame and a multiplicity of suction holders spaced thereabout with working surfaces at the lower ends to engage the sheet. At least one of the suction holders is disposed adjacent one side of the frame and thereby of the uppermost workpiece. A conduit is coupled to the holders and adapted to be coupled to a vacuum source to draw air from the holders and thereby secure the sheet thereto. The holder adjacent the one side is operable to bend the edge portion of the sheet adjacent the one side upwardly from the plane defined by the working surfaces of others of the holders which are spaced further inwardly from the one side.

Preferably, at least one holder adjacent the one side includes at least a first holder spaced at a first close distance to the one side and a second holder spaced at a second greater distance inwardly from the one side. Each of the holders has a suction holder sleeve provided on a suction holder base with the suction holder sleeve of the first holder being compressible to a greater extent than that of the second holder. When vacuum is applied to the workpiece surface, this provides a differential in vertical height to the working surface. The sleeves are of a bellows type configuration provided by multiple folds with the first holder having a greater number of folds than the sleeve of the second holder.

At least one workpiece stop is spaced from the one side along the imaginary line to limit upward movement of the workpiece during the bending process and it and the second holders are disposed along an imaginary connecting line running parallel to the side edge of the workpiece. Preferably, the one holder(s) adjacent the side is uncoupled from other holders placed on the outermost workpiece in the stack.

Preferably, at least one suction holder is disposed on a support structure that can move relative the lifter frame. This support structure is desirably a separator frame pivotally supported on the lifter frame, and at least one suction holder is pivoted thereby from a position in which it is aligned with the suction holders on the lifter frame to a position upwardly therefrom. The separator frame pivots relative to the lifter frame about an axis that is parallel to the one side of the lifter frame.

Also included is at least one separator nozzle mounted on the lifter frame adjacent the one side, and a conduit is connected thereto and adapted to be coupled to a source of pressurized air, whereby pressurized air can be released in the direction of the edge of the workpiece to facilitate separation of the uppermost sheet. This air supply can include means for releasing the pressurized air in pulses, and desirably there are a multiplicity of separator nozzles staggered in relationship along the one side of the frame.

SUMMARY OF THE INVENTION

The invention solves the problem of effecting separation very effectively by means of suction separators that are staggered in relation to one another in the transverse direction of the edge of the workpiece.

The variation in the compressibility of the suction sleeves on the suction separators can be achieved by alternate measures. For example, different amounts of low pressure can be applied to the suction separators on the edge and the suction separators on the inside. The workpiece stop or stops cause a very marked definition of the axis of flexure of the workpiece acted on by the suction separators and at least one suction holder.

The uncoupling of the suction holders and suction separators makes it possible to make the suction separator engage only the outermost workpiece in the stack if another workpiece sticks to it and that is unwanted. In addition, the separation of workpieces that are stuck together can be enhanced by swiveling the supporting structure for at least one suction separator along its axis.

Especially effective to facilitate separation is the pressurized air coming out of the separator nozzle arrangement with a pulsed release toward the gap between the edges of the workpieces.

BRIEF DESCRIPTION OF THE DRAWINGS

The invention will be described in greater detail below using schematic drawings of one embodiment in which.

DETAILED DESCRIPTION OF THE PREFERRED EMBODIMENT

Figure 1:
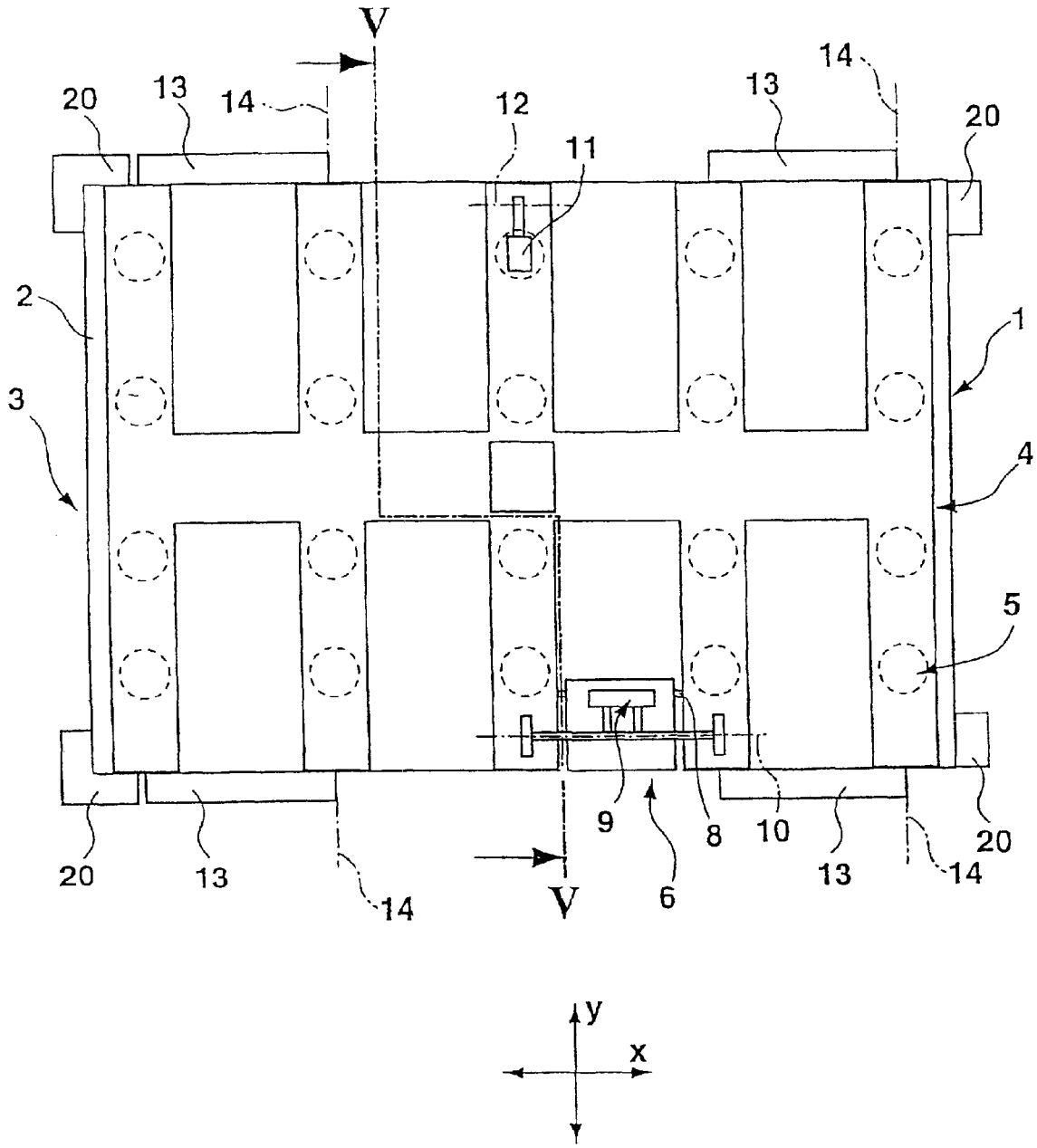
FIG. 1 is a plan view of a lifter and separator for sheets in a stack embodying the present invention.
Figure 5:
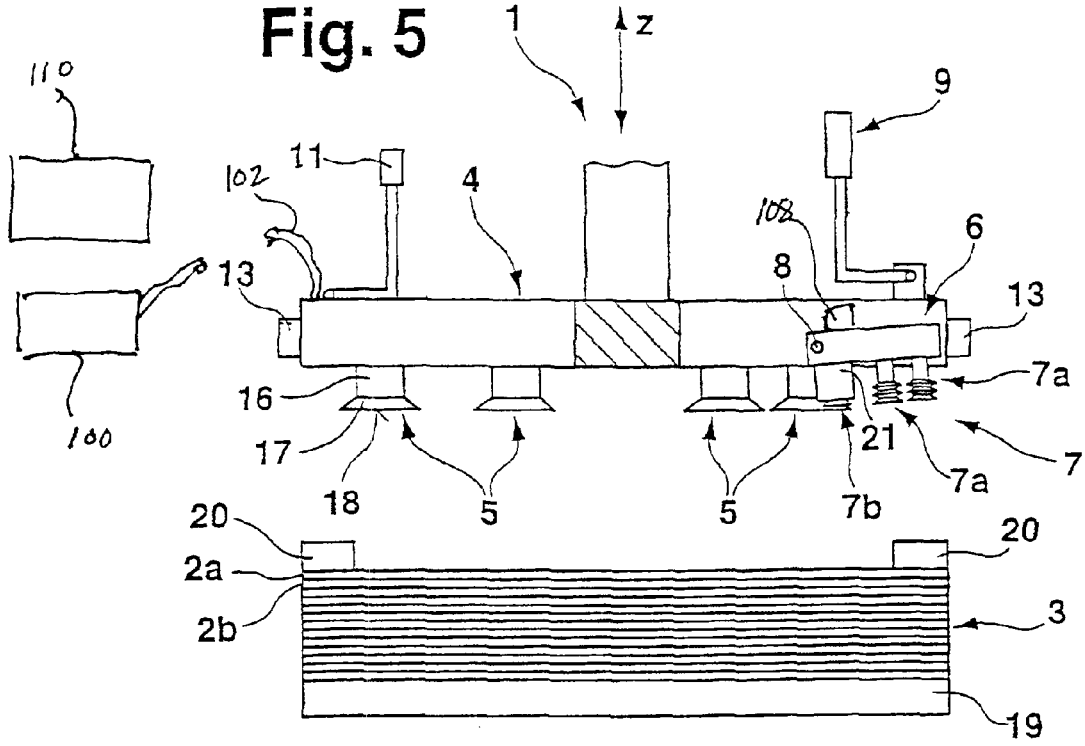
FIG. 5 is a sectional view of the separator of FIG. 1 along the line V—V in FIG. 1.

In FIGS. 1 and 5, there is generally illustrated a lifter and separator 1 embodying the present invention for lifting and isolating single sheets 2 in a stack 3. It is generally comprised of a lifter structure with suction holders 5 and a frame 4, and a separator structure with a suction separator frame 6 and suction holders 7. The suction separator frame 6 is mounted so that it can pivot about a horizontal axis on the shaft 8 which is supported in the lifter frame 4.

The lifter frame 4 supports a separator nozzle 9 so that it can swivel on the lifter frame 4 about a horizontal axis 10. On the lifter frame 4 opposite the separator nozzle arrangement 9 is a sheet metal thickness measuring device 11, and it can swivel about a horizontal axis 12. Guide arms 13 on the lifter frame 4 can pivot about the axes 14.

Movement of the lifter frame 4 can be computer controlled so that it can be moved spatially relative to the stack of sheets 3 in the directions of the x, y, z coordinates seen in FIG. 1. On its lower side facing the stack 3, the lifter frame 4 mounts a plurality of conventional suction holders 5, which are connected to a vacuum or suction source 100 by a pneumatic line 102. As is conventional, the suction holders 5 have a suction holder base 16 and a rubber suction holder sleeve 17 inside it that in turn provides an annular support surface 18 facing the stack 3. The center to center distances between the suction holders 5 are chosen, as are the dimensions of the lifter frame 4, depending on the size of the sheet metal workpiece 2 in the stack 3 to be processed.

The stack 3 of sheet metal 2 rests on a workpiece support or pallet 19. The individual sheets 2 in the stack 3 are supported laterally by means of positioning stops 20 and thereby aligned horizontally.

Figure 2:
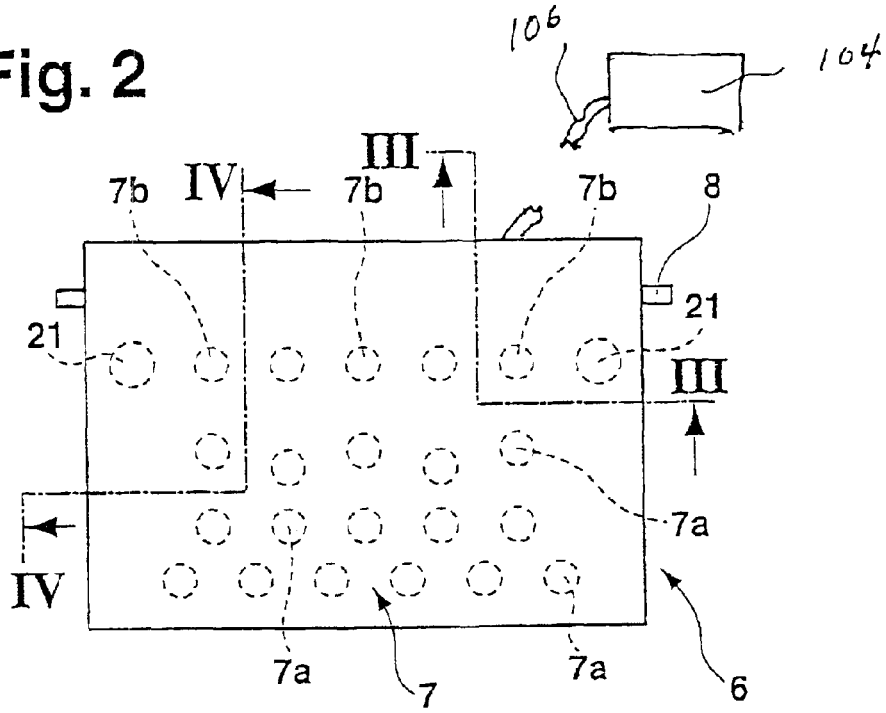
FIG. 2 is a plan view of the separator of FIG. 1.

In FIGS. 1 and 5, the separator frame 6 is located along one longitudinal side of the lifter frame 4 and on the side facing the sheet 2. As can be seen from FIG. 2, the separator frame 6 has a field of suction holders 7 on its lower surface.

A measuring device 11 is disposed along the opposite edge of the lifter frame 4 facing the assigned longitudinal edge of the sheet 2. The outer separator holders 7*a* are adjacent the side of the frame 4, and the inside separator holders 7*b* are between the workpiece stops 21. An imaginary connecting line between the inside suction separator 7*b* and the workpiece stops 21 runs parallel to the longitudinal edge of the sheet 2 assigned to the suction separator holders 7. The separator holders 7 are also connected to the vacuum source 104 for the lifter 1 by lines 106.

Figure 3:
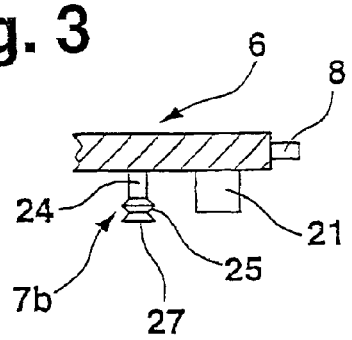
FIG. 3 is an enlarged fragmentary sectional view of the separator of FIG. 2 along the line III—III in FIG. 2.
Figure 4:
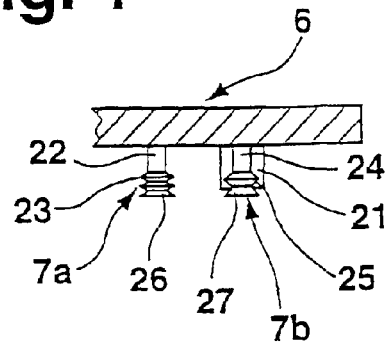
FIG. 4 is an enlarged fragmentary sectional view of the separator of FIG. 2 along the line IV—IV in FIG. 2.

In FIGS. 3 and 4, the separator holders 7*a* on the edge each have a suction base 22 attached to the separator frame 6 and a suction sleeve 23 on the base 22. The inside separator holders 7*b* have a suction base 24 and a suction sleeve 25. On the side facing the stack 3, the suction sleeves 23 of the suction separator holders 7*a* on the edge have a support surface 26, and the suction separator sleeves 25 of the inside suction separator holders 7*b* have a support surface 27. Both the suction sleeves 23 of the separator holders 7*a* along the edge and the suction sleeves 25 of the separator holders 7*b* on the inside are designed as expansible bellows. The number of folds in the suction sleeves 23 on the separator holders 7*a* adjacent the side exceeds the number of folds in the suction sleeves 25 on the inner separator holders 7*b*.

The support surfaces 26, 27 of the separator holders 7*a* on the edge and the separator holders 7*b* on the inside lie in a common plane in their initial or at rest position. The supporting surfaces 26, 27 are disposed inwardly of the stack 3 in relation to the workpiece stops 21. The separator frame 6 with the suction separator holders 7 and workpiece stops 21 on it can be pivoted on the axis 8 by means of a swivel drive mechanism 108. The swivel drive mechanism 108 is operated by a digital computer control 110, like all the other functions of the lifter and separator 1.

The lifter and separator 1 is an integral part of a comprehensive system for processing the sheet metal workpiece 2 and is thus coupled for operation with a conventional sheet metal processing machine tool (not shown). The computer controls for the lifter and separator are built into the CNC controls for the whole installation.

FIG. 5 shows the lifter and separator 1 in the starting position. It is spaced a short distance above the stack 3 of sheet metal workpieces 2. The separator frame 6 is slightly inclined and pivots upwardly with its free end above the horizontal. For the sake of simplicity, in FIG. 5 and the subsequent FIGS. 6 to 11, only one part of the suction holders 7 provided on the separator frame 6 is shown. The surfaces 26 of the separator holders 7*a* on the edge that are on the separator frame 6 and the support surfaces 27 of separator holders 7*b* on the inside lie in a common plane that lies according to the inclination of the separator frame 6 and are mounted in front of the free ends of the workpiece stops 21 facing the stack 3 of sheet metal. The supporting surfaces 18 of the holders 5 are closer to the stack 3 of sheet metal than the support surfaces 26, 27 of the outer separator holders 7*a* and the inside separator holders 7*b*.

The separator nozzle assembly 9 and the sheet metal thickness measuring device 11 pivot on the side of the lifter frame 4 facing away from the stack 3 and are in their rest position there. The guide arms 13, which extend horizontally along the lifter frame 4, are also shown in the at rest position.

Figure 6:
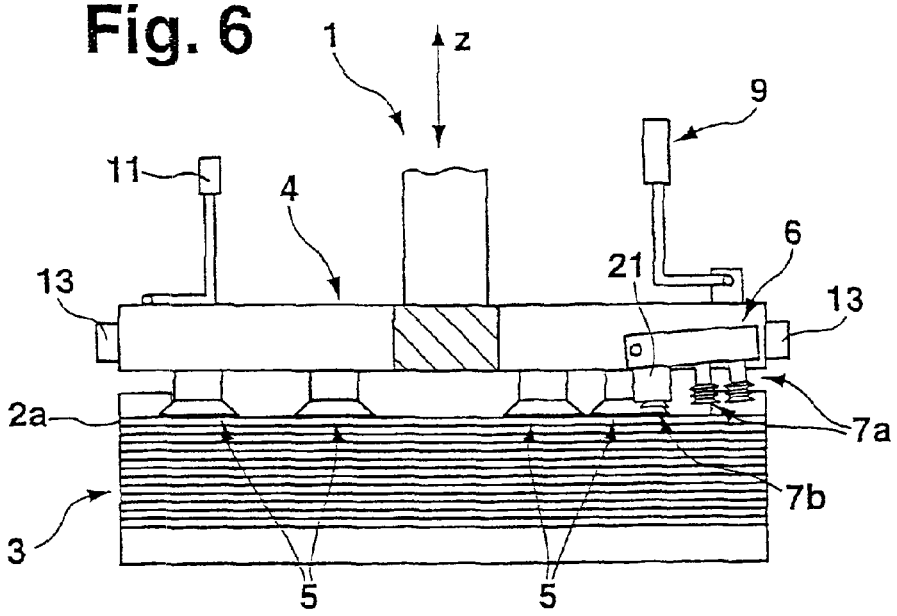
FIGS. 6 to 11 are sectional views similar to FIG. 5 of the separator of FIG. 1 in different stages in the operation of separating the uppermost workpiece.

The sheet metal workpiece 2 initially lying uppermost in the stack 3 of sheets is marked "2*a*" in FIGS. 5 to 11 and the one under it "2*b*." Now, if sheet 2*a* of stack 3 is to be picked up, the lifter and separator 1, starting from its position in FIG. 5, descends in direction z onto the stack 3 as seen in FIG. 6. The lifter holders 5 with their support surfaces 18 are placed on the surface of the outermost metal sheet 2*a* in the stack 3 facing them. The separator frame 6 is upwardly in its starting position in FIG. 5. Support surfaces 26, 27 of the separator holders 7*a* adjacent the edge and of the separator holders 7*b* on the inside are separated slightly from the sheet 2*a* to be gripped by the lifter holders 5.

By controlling the vacuum source using the computer control 110 for the lifter and separator 1, low pressure or suction is then applied to the lifter holders 5. As a result, they stick to sheet 2*a*. There is no contact between sheet 2*a* and the separator holders 7*a* on the edge and the separator holders 7*b* on the inside of the separator frame 6, as before. All in all, the relationships are shown in FIG. 6.

The lifter and separator 1 with the sheet 2*a* held by suction is then raised in direction z, and the sheet metal thickness measuring device 11 is swiveled out of its at rest position in FIGS. 5 and 6 on axis 12 into its working position, in which the measuring head of the conventional sheet metal thickness measuring device 11 is disposed at the height of the sheet 2*a* held by the lifter holders 5. The separator frame 6 and the separator nozzle arrangement 9 and the guide arms 13 are in their starting positions.

Figure 7:
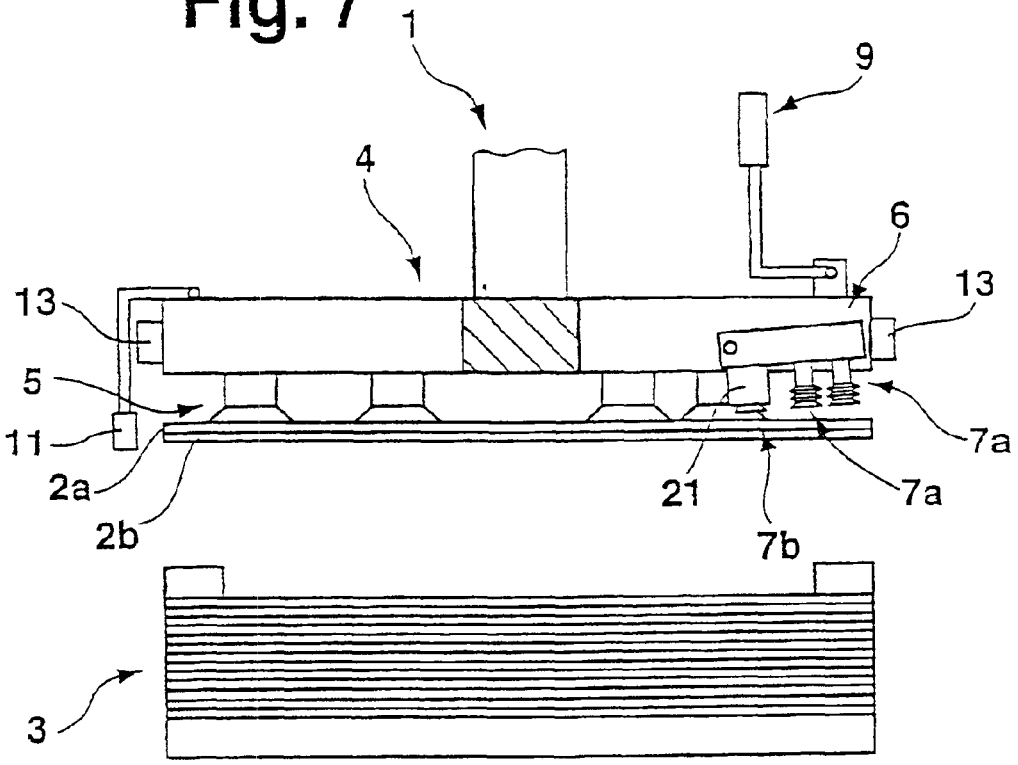

The sheet metal thickness measuring device 11 is used to check whether the lifter and separator 1 lifted only sheet 2*a* as desired, or inadvertently lifted two or more adhered sheets 2 from the stack 3. As illustrated in FIG. 7, it determines that sheet 2*b* is sticking to the sheet 2*a* which was topmost in the stack 3 and is held by the holders 5; this is not desired.

Figure 8:
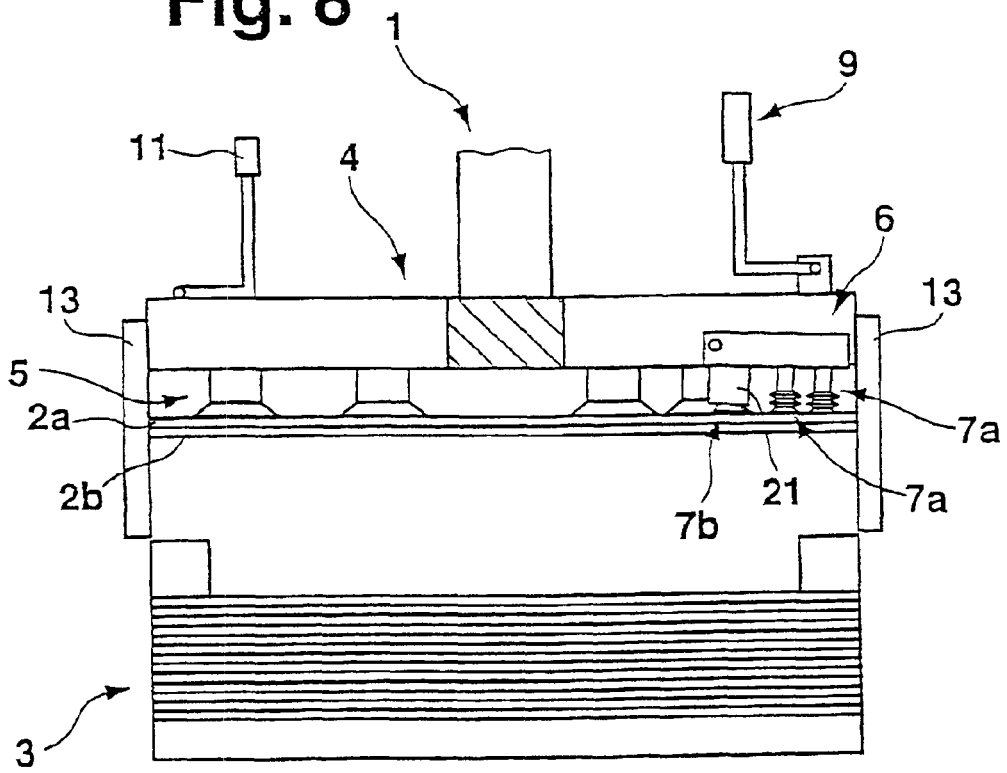

Because of the measurement results from the sheet metal thickness measuring device 11, the guide arms 13 controlled by the computer control 110 for the lifter and separator 1 are pivoted out of their horizontal resting position into their vertical working position as seen in FIG. 8. At the same time, the separator frame 6 is pivoted downwardly from its starting position about axis 8 by a pneumatic piston/cylinder (not shown). The separator holders 7*a* along the edge and the separator holders 7*b* on the inside thus come to lie with their support surfaces 26, 27 on the surface of sheet 2*a* facing them. The separator nozzle assembly 9 is returned to its at rest position. The sheet metal thickness measuring device 11 is also pivoted back up into the at rest position.

Low pressure or vacuum is applied to the edge separator holders 7*a* and the inside suction separator holders 7*b* by controlling the vacuum source 104 of the lifter and separator 1 on the separator frame 6 which has swiveled downwardly slightly toward the horizontal plane, as before. The effect of the low pressure or vacuum is to compress the suction separator sleeves 23 on the edge suction separator holders 7*a* and the suction separator sleeves 25 on the inside suction separator holders 7*b*. As a result, sheets 2*a*, 2*b* which are held on the lifter and separator 1 are pulled along the longitudinal edge assigned to the suction separator holders 7 against the workpiece stops 21. At a level with the free end of the workpiece stop 21, the support surfaces 27 are now on the inside suction separator holders 7*b*.

The suction separator sleeves 23 of the outer suction separator holders 7*a* are compressed as a result of the low pressure applied more than the suction separator sleeves 25 on the inside suction separator holders 7*b*. Accordingly, the support surfaces 26 of the outer suction separator holders 7*a* on the opposite surface of sheet 2*a* are set back in the transverse direction of the sheet surface toward the free end of the workpiece stop 21 and the support surface 27 of the inside suction separator holders 7*b*. As a result, the two adhered sheets 2*a*, 2*b* are bent along their longitudinal edge assigned to the suction separator holders 7 along an axis defined by the workpiece stops 21 and the inside suction separator holders 7*b* to the side of the sheet 2*a* being acted on by the suction holders 5 and the suction separators 7, i.e., to the side of the lifter and separator 1. Due to its inherent elasticity, sheet 2*b* is stuck to sheet 2*a* and is acted upon directly by the suction holders 5 and the suction separators 7. It automatically tries to return its flat form. Because of the elastic return forces working on it, sheet 2*b* begins to loosen from sheet 2*a* starting from its longitudinal edge assigned to the suction separator holders 7. The several relationships are shown in FIG. 9.

Figure 9:
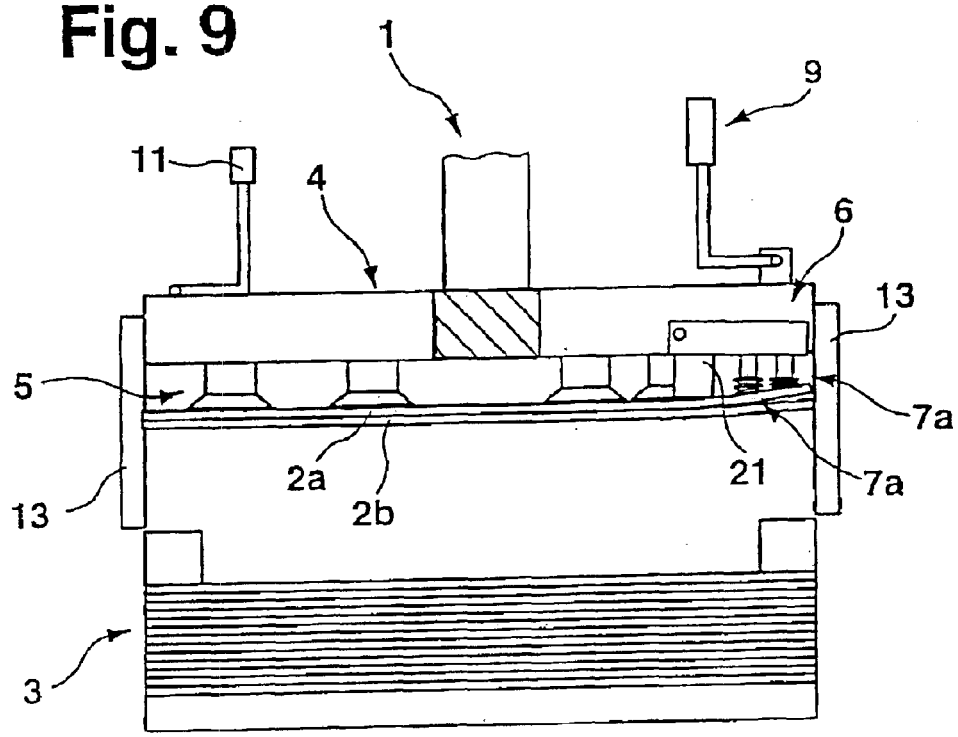
Figure 10:
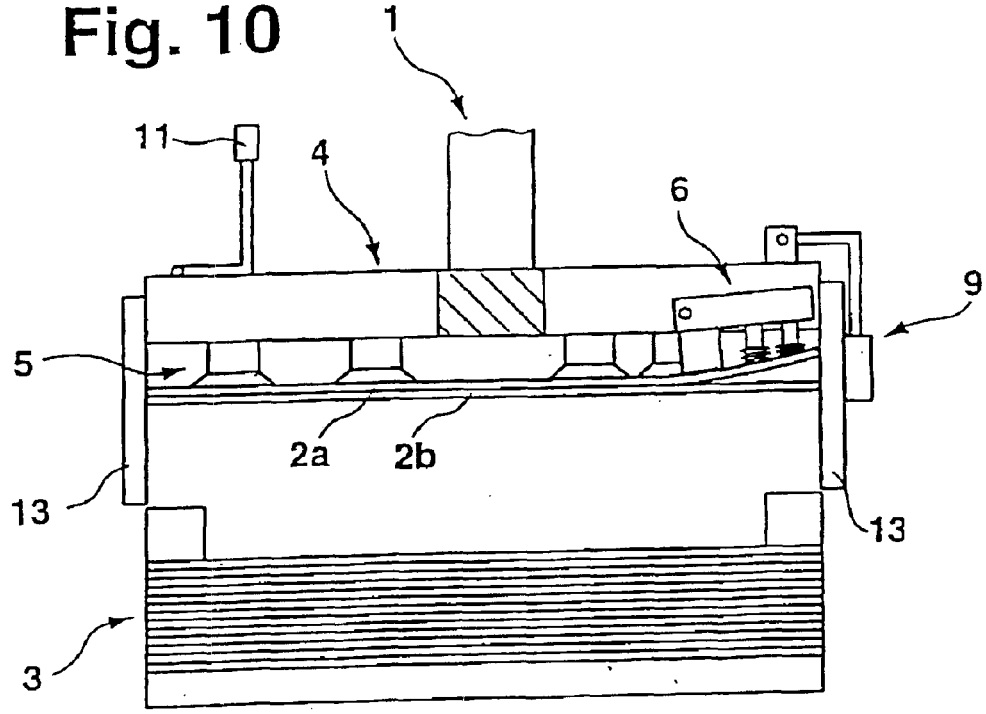

This separation of the two sheets 2*a*, 2*b* initiated automatically is assisted by pivoting the separator frame 6 from the position in FIG. 9 to its starting position in FIG. 10. The edge suction separator holders 7*a* and the inside suction separator holders 7*b* are again compressed due to the effect of the low pressure applied to them. Sheet 2*a* is again drawn towards workpiece stops 21.

The pivotal movement of the separator frame 6 described above increases the bending of the "double sheet" held on the separator 1. This is accompanied by an increase in the elastic return force acting on sheet 2*b* and an acceleration of the separation of the two sheets 2*a*, 2*b* along the longitudinal edges.

Figure 12:
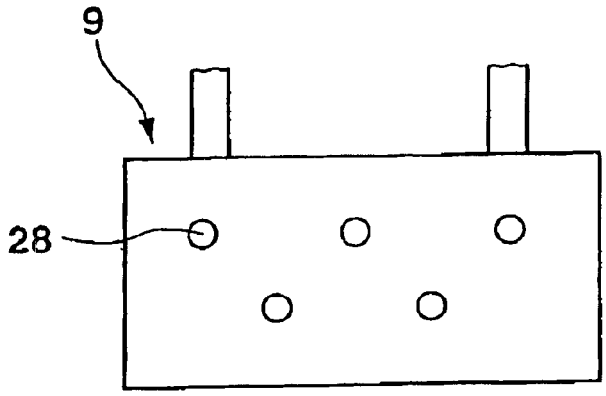
FIG. 12 is a plan view of the separator in FIG. 1.

Compressed air, as a flowing pressure medium, is released toward the front edge of the sheets into the gap along the longitudinal edge of the sheets 2*a*, 2*b* through a nozzle assembly 9 shown in FIG. 12. This compressed air facilitates the separation of the two sheets 2*a*, 2*b* held on the lifter and separator 1.

Figure 11:
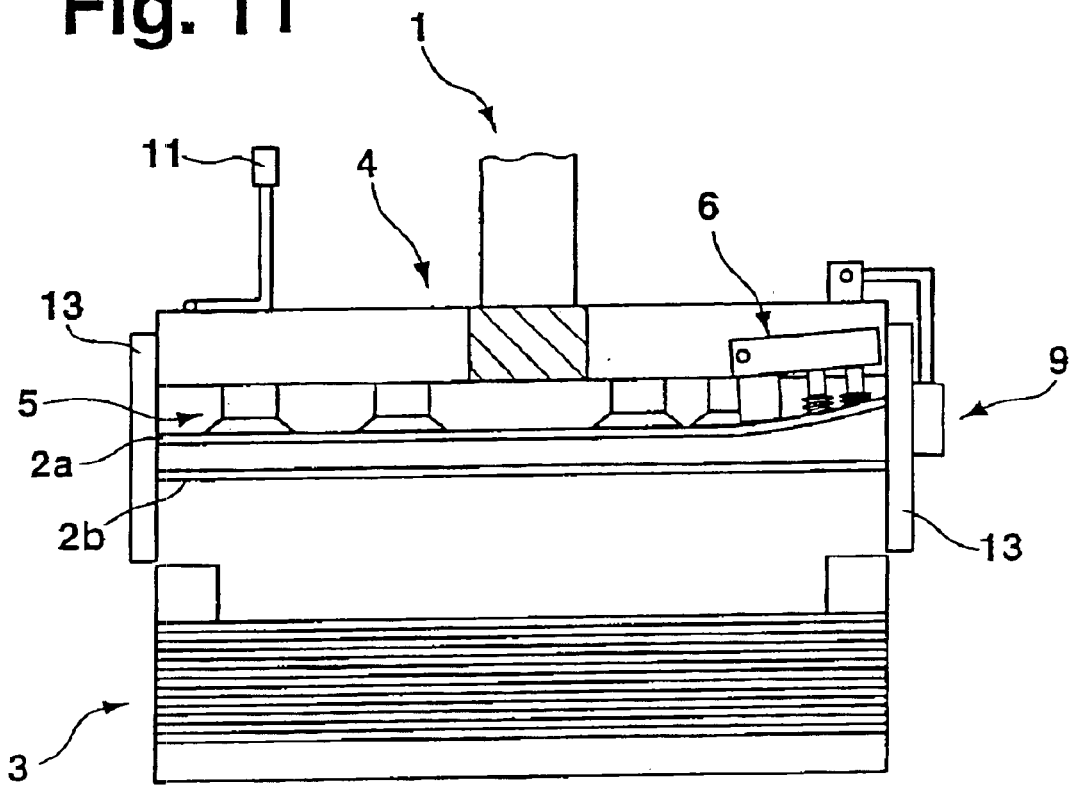

If the gap has advanced far enough between the inside of sheets 2*a*, 2*b*, then the gravitational force acting on the sheet 2*b* makes it completely separate from the upper sheet 2*a* held directly on the lifter and separator 1. The loose sheet 2*b* then falls back onto the stack 3 of sheets. The guide arms 13 go into their working position, interacting with the positioning stops 20 on the workpiece support 19, to make sure that sheet 2*b* falls down in alignment with the other sheets 2 in the stack 3, all as shown in FIG. 11.

The nozzle assembly 9 is shown in detail in FIG. 12. The nozzle outlets 28, are disposed opposite the longitudinal edge of the sheets 2*a*, 2*b* which are stuck together in the working position of the separator nozzle assembly 9 as seen in FIGS. 10, 11. In FIG. 12, the nozzle outlets 28 are staggered in relation to one another along the edge of the sheets 2*a*, 2*b* assigned to the suction separator holders 7 and in the transverse direction of the surface of the sheets acted on by the suction separator holders 7. The compressed air at the nozzle outlets 28 of the separator nozzle assembly 9 is pulsed.

The edge suction separator holders 7*a* and the inside suction separator holders 7*b* are switched to atmospheric pressure after sheet 2*b* which is stuck to sheet 2*a* is loosened. The edge of sheet 2*a* acted on can consequently spring back into its horizontal position. After the sheet metal thickness measuring device 11 checks the measurement, sheet 2*a*, held on the lifter and separator 1 by means of the suction holders 5 under low pressure, may be transported by a transport assembly associated with the separator 1 (not shown) to the workpiece support of a machine tool associated with the lifter and separator 1 and deposited there.

As an alternative to the process described above, the suction separator holders 7 can also be applied to the sheet 2*a* when it is still lying on the stack 3 of sheet metal. In this case, the lifter frame 4 is lowered from the raised position in FIG. 5 into the position in FIG. 6. The suction holders 5 then act on the surface of sheet 2*a* facing them, but not necessarily under low pressure. The suction separator frame 6 is swiveled down out of its at rest position, as illustrated in FIG. 8; the edge suction separator holders 7*a* and the inside suction separator holders 7*b* come to rest on the surface of sheet 2*a*. Now, if low pressure is applied to the holders 7, sheet 2*a* is lifted on its edge assigned to the separator holders 7. If sheet 2*a* sticks to sheet 2*b*, the latter is also elastically deformed on the edge. Because of this elastic deformation alone and the elastic return forces caused by it, sheet 2*b* may come loose from sheet 2*a*. To facilitate the separation of sheets 2*a*, 2*b*, the additional measures explained with FIGS. 10 and 11 pivoting the suction separator frame 6 into the starting position, releasing compressed air by means of the separator nozzle arrangement 9 can be taken. Then, the separated sheet 2*a* adhered to the holders 5 is lifted off the stack 3 of sheets, and the suction separator holders 7 are without pressure. After a check by the sheet metal thickness measuring device 11, sheet 2*a* is finally sent to the workpiece support of the machine tool associated with the lifter and separator 1. The measures described for separating sheets in stack 3 can also be taken routinely, regardless of whether or not a sheet 2*b* actually sticks to the sheet 2*a*.

Having thus described the invention, what is claimed is:

1. In a sheet lifter and separator for lifting and separating the uppermost sheet of a stack of workpieces from the sheet disposed therebelow, the combination comprising:

(a) a lifter including a frame and a multiplicity of suction holders spaced thereabout with working surfaces at their lower ends to engage the sheet, and a separator frame pivotably mounted on said lifter frame for pivotable movement about an axis parallel to one side of said lifter frame, at least one suction holder and a workpiece stop being disposed on said separator frame adjacent one side of the uppermost workpiece in the stack, said workpiece stop being spaced inwardly from said one side and said at least one suction holder, said at least one suction holder being compressible vertically relative to the horizontal plane of said separator frame to a position above the lower surface of said workpiece stop to effect bending of the workpiece about said stop;

(b) drive means for pivoting said separator frame upwardly relative to said lifter frame to bend the one side of the workpiece upwardly; and (c) conduit means coupled to said suction holders and adapted to be coupled to a vacuum source to draw air from said suction holders and thereby secure the sheet thereto, said at least one suction holder adjacent said one side being operable to bend the edge portion of the sheet adjacent said one side upwardly from the plane defined by the working surfaces of others of said suction holders spaced further inwardly from said one side.

2. In a sheet lifter and separator for lifting and separating the uppermost sheet of a stack of workpieces from the sheet disposed therebelow, the combination comprising:

(a) a lifter including a frame and a multiplicity of suction holders spaced thereabout with working surfaces at their lower ends to engage the sheet, and a separator frame pivotably mounted on said lifter frame for pivotable movement about an axis parallel to one side of said lifter frame, at least one suction holder and a workpiece stop being disposed on said separator frame adjacent one side of the uppermost workpiece in the stack, said workpiece stop being spaced inwardly from said one side and said at least one suction holder, said at least one suction holder being movable to a position above the lower surface of said workpiece stop;

(b) drive means for pivoting said separator frame relative to said lifter frame; and (c) conduit means coupled to said suction holders and adapted to be coupled to a vacuum source to draw air from said suction holders and thereby secure the sheet thereto, said at least one suction holder adjacent said one side being operable to bend the edge portion of the sheet U adjacent said one side upwardly from the plane defined by the working surfaces of others of said suction holders spaced further inwardly from said one side, said at least one suction holder adjacent said one side includes at least a first suction holder spaced at a first close distance from said one side and a second suction holder spaced at a second greater distance inwardly from said one side, each of said suction holders having a suction holder sleeve provided on a section holder base, said suction holder sleeve of said one suction holder being compressible to a greater extent than that of said second suction holder by the vacuum applied in the direction of the workpiece surface, said differential in compression producing a differential in the vertical spacing of said first suction holder from said working surface.

3. A sheet lifter and separator in accordance with claim 2 wherein said suction holder sleeves are of a bellows-type configuration provided by multiple folds with said one suction holder having a greater number of folds than the sleeve of said second suction holder.

4. A sheet lifter and separator in accordance with claim 1 wherein said at least one suction holder is uncoupled from other holders placed on the outermost workpiece in the stack.

5. A sheet lifter and separator in accordance with claim 1 wherein there are included at least one separator nozzle mounted on said lifter frame adjacent said one side and a conduit connected thereto and adapted to be coupled to a source of pressurized air, whereby pressurized air can be released in the direction of the edge of the workpieces to facilitate separation of the uppermost sheet.

6. A sheet lifter and separator in accordance with claim 5 including means for releasing the pressurized air in pulses.

7. A sheet litter and separator in accordance with claim 5 wherein there are a multiplicity of separator nozzles in staggered relationship among the one side of the lifter frame assigned to the suction separators.

8. A sheet lifter and separator for lifting and separating the uppermost sheet of a stack of workpieces from the sheet disposed therebelow comprising:

(a) a lifter including a frame and a multiplicity of suction holders spaced thereabout;

(b) a separator frame along one side of said lifter frame and including a frame having an end spaced from said one side of said lifter frame and pivotably mourted on said frame for pivotal motion about an axis parallel to said one side of said lifter frame between a horizontal position parallel to said lifter frame and a position angled upwardly, said separator frame supporting a multiplicity of separator suction holders at positions adjacent said one side and spaced therefrom, a workpiece stop on said separator frame spaced inwardly from said one side of said lifter frame and from at least one of said suction holders on said separator frame, said one suction holder being compressible vertically relative to the horizontal plane of said separator frame to a position above the lower surface of said workpiece stop to effect bending of the workpiece about said stop, said lifter suction holders and said separator suction holders having nozzles with working surfaces at their lower ends;

(c) conduits extending from said suction holders and adapted to be connected to a vacuum source;

(d) drive means for moving said lifter frame upwardly and downwardly relative to a stack of workpieces disposed therebelow;

(e) drive means for pivoting said separator frame upwardly relative to said lifter frame to bend the one side of the workpiece upwardly; and (f) control means for the vacuum source and drive means; and (g) control means operative to move said holder frame downwardly to a position in which said lifter suction holders thereon grip the topmost sheet of the stack and lift it upwardly, said control means also being operative to bring the separator suction holders against the topmost sheet and engage the sheet adjacent said one side and thereafter to pivot the separator frame upwardly to vary the vertical position of the nozzles of said at least one said separator suction holders relative to the position of the nozzles of said lifter suction holders to bend the one side of the topmost sheet and cause the one side of the topmost sheet to separate from the sheet adhered to its lower surface.

9. A sheet lifter and separator for lifting and separating the uppermost sheet of a stack of workpieces from the sheet disposed therebelow comprising:

(a) a lifter including a frame and a multiplicity of suction holders spaced thereabout;

(b) a separator frame along one side of said lifter frame and including a frame having an end spaced from said one side of said lifter frame and pivotably mounted on said frame for pivotal motion about an axis parallel to said one side of said lifter frame between a horizontal position parallel to said lifter frame and a position angled upwardly, said separator frame supporting a multiplicity of separator suction holders at positions adjacent said one side and spaced therefrom, a workpiece stop on said separator frame spaced inwardly from said one side of said lifter frame and from at least one of said suction holders on said separator frame, said one suction holder being compressible vertically relative to the horizontal plane of said separator frame to a position above the lower surface of said workpiece stop to effect bending of the workpiece about said stop, said lifter suction holders and said separator suction holders having nozzles with working surfaces at their lower ends, said suction holders on said separator include said at least one suction holder spaced at a first close distance to said one side and a second suction holder spaced at a second greater distance each of said suction holders having a suction holder sleeve provided on a suction holder base, said suction holder sleeve of said at least one separator suction holder being compressible by the vacuum to a greater extent than that of said second holder to provide a differential in vertical height to said working surfaces;

(c) conduits extending from said suction holders and adapted to be connected to a vacuum source;

(d) drive means for moving said lifter frame upwardly and downwardly relative to a stack of workpieces disposed therebelow;

(e) drive means for pivoting said separator frame upwardly relative to said separator lifter frame to effect bending; and (f) control means for the vacuum source and drive means; and (g) control means operative to move said holder frame downwardly to a position in which said lifter suction holders thereon grip the topmost sheet of the stack and lift it upwardly, said control means also being operative to bring the separator suction holders against the topmost sheet and engage the sheet adjacent said one side and thereafter to pivot the separator frame upwardly to vary the vertical position of the nozzles of said at least one said separator suction holders relative to the position of the nozzles of said lifter suction holders to bend the one side of the topmost sheet and cause the one side of the topmost sheet to separate from the sheet adhered to its lower surface.

10. A sheet lifter and separator in accordance with claim 9 wherein said sleeves are of a bellows-type configuration provided by multiple folds with said first holder having a greater number of folds than the sleeve of said second holder.

11. A sheet lifter and separator in accordance with claim 8 wherein there are included at least one separator nozzle mounted on said lifter frame adjacent said one side and a conduit connected thereto and adapted to be coupled to a source of pressurized air, whereby pressurized air can be released in the direction of the edge of the workpieces to facilitate separation of the uppermost sheet.

12. A sheet lifter and separator in accordance with claim 11 including means for releasing the pressurized air in pulses.

13. A sheet lifter and separator in accordance with claim 11 wherein there are a multiplicity of separator nozzles in staggered relationship along the one side of the frame assigned to the suction separators.

14. In a sheet lifter and separator for lifting and separating the uppermost sheet of a stack of workpieces from the sheet disposed therebelow, the combination comprising:

(a) a lifter including a frame and a multiplicity of suction holders spaced thereabout with working surfaces at their lower ends to engage the sheet, at least one of said suction holders being disposed adjacent one side of said frame and thereby of the uppermost workpiece, said at least one holder adjacent said one side including at least a first holder spaced at a first close distance to said one side and at least a second holder spaced at a second greater distance inwardly from said one side, each of said suction holders having a suction holder sleeve provided on a suction holder base, said suction holder sleeve of said at least one holder being compressible to a greater extent than that of said at least second holder by the vacuum applied in the direction of the workpiece surface, said differential in compression producing a differential in the vertical spacing of said at least one suction holder from said working surface; and (b) conduit means coupled to said holders and adapted to be coupled to a vacuum source to draw air from said holders and thereby secure the sheet thereto, said at least one holder adjacent said one side being operable to bend the edge portion of the sheet adjacent said one side upwardly from the plane defined by the working surfaces of others of said holders spaced further inwardly from said one side.

15. A sheet lifter and separator for lifting and separating the uppermost sheet of a stack of workpieces from the sheet disposed therebelow comprising:

(a) a lifter including a frame and a multiplicity of suction holders spaced thereabout;

(b) a separator frame along one side of said lifter frame and including a frame having an end spaced from said one side of said lifter frame and pivotably mounted on said frame about an axis parallel to said one side of said lifter frame for pivotal motion between a horizontal position parallel to said lifter frame and a position angled upwardly, said separator frame supporting a multiplicity of separator suction holders including at least suction holder adjacent said one side and others spaced therefrom, said lifter holders and said separator suction holders having nozzles with working surfaces at their lower ends, each of said holders having a suction holder sleeve provided on a suction holder base, said suction holder sleeve of said at least one suction holder being compressible by the vacuum to a greater extent than that of another holder spaced inwardly therefrom to provide a differential in vertical height to said working surfaces;

(c) conduits extending from said suction holders and adapted to be connected to a vacuum source;

(d) drive means for moving said lifter frame upwardly and downwardly relative to a stack of workpieces disposed therebelow and said control means operative to move said holder frame downwardly to a position in which said lifter holders grip the topmost sheet of the stack and lift it upwardly, said control means also being operative to bring the separator holders against the topmost sheet and engage the sheet adjacent said one side and thereafter to pivot the separator frame upwardly to vary the vertical position of the nozzles of said separator holders relative to the position of the nozzles of said lifter holders to bend the one side of the topmost sheet and cause the one side of the topmost sheet to separate from the sheet adhered to its lower surface;

(f) drive means for pivoting said separator frame; and (g) control means for the vacuum source and drive means.

* * * * *